US005375627A

United States Patent [19]

Iida et al.

[11] Patent Number: 5,375,627

[45] Date of Patent: Dec. 27, 1994

[54] METHOD AND WEAVING MACHINE FOR PRODUCING MULTI-AXIAL FABRIC

[75] Inventors: Shigenobu Iida, Nagoya; Chikaji Ohmori, Ichinomiya; Takao Ito, Aichi, all of Japan

[73] Assignee: Howa Machinery, Ltd., Japan

[21] Appl. No.: 117,939

[22] Filed: Sep. 8, 1993

[51] Int. Cl.[5] ..... D03D 13/00; D03D 41/00

[52] U.S. Cl. ..... 139/11; 139/48; 139/DIG. 1

[58] Field of Search ..... 139/11, 48, DIG. 1

[56] References Cited

U.S. PATENT DOCUMENTS

| | | | |
|---|---|---|---|
| 539,405 | 5/1895 | Bancroft | 139/DIG. 1 X |
| 3,965,939 | 6/1976 | Kulczycki et al. . | |
| 3,998,250 | 12/1976 | Townsend | 139/DIG. 1 X |
| 4,013,103 | 3/1977 | Kulczycki et al. . | |
| 4,022,250 | 5/1977 | Trost | 139/DIG. 1 X |
| 4,046,173 | 9/1977 | Kulczycki . | |
| 4,105,052 | 8/1978 | Trost et al. . | |
| 4,140,156 | 2/1979 | Trost . | |
| 4,170,249 | 10/1979 | Trost | 139/11 |
| 4,438,173 | 3/1984 | Trost . | |

FOREIGN PATENT DOCUMENTS

| | | |
|---|---|---|
| 56-42380 | 10/1981 | Japan . |
| 58-163750 | 9/1983 | Japan . |
| 60-54417 | 11/1985 | Japan . |
| 63-92751 | 4/1988 | Japan . |
| 1292140 | 11/1989 | Japan . |
| 26649 | 1/1990 | Japan . |

*Primary Examiner*—Andrew M. Falik

*Attorney, Agent, or Firm*—Stevens, Davis, Miller & Mosher

[57] ABSTRACT

A weaving machine having opposite arrays of first heddles which are subjected to an alternative weft-wise movement. The weaving machine is also provided with opposite arrays of second heddles which are arranged on one side of the respective arrays of the first heddles adjacent the cloth fell. The weaving machine is operative to manufacture a multi-axial fabric constructed by a triaxial fabric including oblique warp yarns of different direction which are interwoven in weft yarns, and straight warp yarns interwoven with the weft yarns constructing the triaxial fabric. At all of the locations where the oblique warp yarns are crossed with each other, the oblique warp yarns and the weft yarns are interwoven with each other, and the straight warp yarns are interwoven with the weft yarns which are interwoven with the oblique warp yarns.

5 Claims, 12 Drawing Sheets

A
α
α'
Y
β
β'
S
Q
R
4
3
2
1
αα'ββ'
αα'
αα'ββ'
αα'

METHOD AND WEAVING MACHINE FOR PRODUCING MULTI-AXIAL FABRIC

BACKGROUND OF THE INVENTION

1. Field of the Invention

The present invention relates to a method and weaving machine for producing a multi-axial fabric comprising a triaxial fabric having two sets of obliquely arranged warp yarns of different direction and a set of weft yarns, which are interwoven, and a set of warp yarns which are transverse to the weft yarns and which are interwoven to the weft yarns of the triaxial fabric.

Definition:

The term "oblique warp yarns" means warp yarns which, after being woven to a fabric, run along a direction which is oblique with respect to a weft-wise direction.

The term "straight warp yarns" means warp yarns which, after woven to a fabric, run along a direction which is transverse to the weft-wise direction.

2. Description of Related Art

A triaxial fabric is known in, for example, U.S. Pat. No. 4,438,173 by Wayne. In this basic type of a triaxial fabric, two sets of oblique warp yarns are interwoven with a set of weft yarns. In order to obtain such triaxial fabric, a weaving machine is proposed, where a pair of opposite, spaced arrays of heddles are provided for supporting two sets of oblique warp yarns. The heddles are alternately arranged between the opposite arrays and are subjected to reciprocal movement so that the heddle between the opposite arrays are crossed with each other, which causes a shed to be created to which a weft yarn is introduced, to which a beating movement by a beater is applied to create a cloth fell. Furthermore, a mechanism is provided for obtaining an endless, alternate, opposite, weft-wise, stepwise movement of the opposed arrays of heddles every time after the execution of the beating movement, so that, after being interwoven to the weft yarns, the oblique warp yarns are arranged oblique to the weft direction.

Known from Japanese Unexamined Patent Publication (Kokai) No. 63-92751 is a weaving machine which includes a pair of delivery rolls defining thereon helical grooves for displacing two sets of oblique warp yarns (upper oblique warp yarns and lower oblique warp yarns) oppositely along the weft direction, a guide roll arranged on one side of the delivery rolls adjacent the cloth fell for guiding another set of straight warp yarns, and push type-heddles of a fork shape for obtaining a downward movement of the upper oblique warp yarns for creating a shed so that the upper, oblique warp yarns are interwoven with the lower weft yarns, and so that the lower oblique warp yarns and the straight warp yarns are sandwiched between the upper, oblique warp yarns and the lower weft yarns.

The Japanese Unexamined Patent Publication No. 1-292140 discloses a weaving machine which comprises two sets of horizontal, opposite, spaced arrays of heddles, for guiding two sets of arrays of oblique warp yarns, and elongated rocking heddle levers for supplying straight warp yarns at locations inwardly of the arrays of the oblique warp yarns. The heddle levers effect their designated movement at the area inwardly of the arrays of the oblique warp yarns so that the straight warp yarns are interwoven to a fabric from the inner side of the oblique warp yarns.

The Japanese Unexamined Patent Publication No. 2-6649 discloses a weaving machine which has loops of guide chains on which heddle guide needles for oblique warp yarns are vertically movably supported. The guide chain rotates about vertical axes for obtaining stepwise, weft-wise movement of the oblique warp yarns as is necessary to obtain usual triaxial fabric as illustrated in U.S. Pat. No. 4,438,173. Furthermore, on one side of the arrays of the guide needles, away from the cloth fell, transverse arrays of heddle guide needles for straight warp yarns are provided. These needles are subjected to a designated shedding movement so that the straight warp yarns are interwoven to a weft yarn.

Furthermore, in the Japanese Examined Utility Model Publication No. 56-42380, a weaving machine is provided, where upper and lower heddles of a pushing type for straight warp yarns are used for obtaining simultaneous movement of the straight warp yarns and one of the sets of the oblique warp yarns to create a shed into which the weft yarn is inserted. Namely, straight warp yarns are arranged is parallel, while two sets of oblique warp yarns are shedded, so that a weft yarn is inserted to the shed on one side of the straight warp yarns. As a result, a fabric is obtained where the straight warp yarns are located between the oblique warp yarns and a weft yarn. In this patent, the heddles can only move the one set of the oblique warp yarns.

Finally, Japanese Patent Publication No. 58-163750 discloses a multi-axial fabric comprising oblique warp yarns of different direction and straight warp yarns.

In the Japanese Unexamined Patent Publication No. 63-92751, due to the employment of the fork-shaped pressing heddles which need a large transverse width for maintaining a desired action for pressing the oblique warp yarns, the spacing between adjacent oblique warp yarns must be large, which causes the fabric, as produced, to be relatively coarse. Furthermore, the construction of the fabric is such that four sets of the yarns (a set of weft yarns, two sets of oblique warp yarns and a set of straight warp yarns) are arranged in such a manner that two sets of yarns are woven while sandwiching, therebetween, the other two sets of yarns, which causes the woven structure of the yarns to be unstable, causing the fabric to be easily deformed when subjected to an outer tension. In particular, when the construction is such that the upper and lower sets of the oblique warp yarns are sandwiched between the straight warp yarns and weft yarns, the instability of the structure becomes extremely high.

The Japanese Unexamined Patent Publication No. 1-292140 is advantageous from the view-point of economy due to the fact that a conventional-type weaving machine for triaxial fabric is modified so that another set of elongated heddle levers are added. However, such an additional set of elongated heddle levers for the straight warp yarns must be provided in a very limited space inwardly of the opposite arrays of the heddle for the oblique warp yarns. This causes the device to be complicated, on one hand, and the cost to be increased, on the other hand. Furthermore, straight warp yarns must be done by moving the elongated heddle levers via spaces between adjacent oblique warp yarns. Thus, there is a lower limit in the spacing between the adjacent oblique warp yarns, causing the fabric to become coarse. The produced fabric has a construction that the straight warp yarns are arranged between the two sets of oblique warp yarns of different directions. Namely, the straight warp yarns are interwoven to the weft yarns from the inner side, which causes the fabric to become unstable, due to the fact that the spacing between adjacent straight warp yarns can easily be changed, on one hand, and makes the weaving machine to be of a complicated structure, on the other hand.

In the Japanese Unexamined Patent Publication No. 2-6649, the shedding movement of the oblique warp yarns is done by the oblique warp yarn guide needles which are mounted on the guide chain, which causes the fabric to become coarse. Furthermore, the oblique warp yarns and the straight warp yarns are merely selectively interwoven, causing instability of the woven structure. Namely, only one weft yarn among four weft yarns constructing one repeat unit is interwoven with the oblique warp yarns, which makes the fabric unstable. In other words, the oblique warp yarns are interwoven to the weft yarn only at limited portions where the oblique warp yarns cross each other.

In Japanese Examined Utility Model Publication No. 56-42380, one set of the oblique warp yarns moves to together with the straight warp yarns. Thus, at the points where the oblique warp yarns of different directions are crossed with each other due to the fact that the heddles can move only one set of the oblique yarns, the straight warp yarns cannot always be interwoven with the weft yarns, causing the fabric as produced to be unstable.

In the Japanese Unexamined Patent Publication No. 58-163750, among all the points where the oblique warp yarns are interwoven with the weft yarns, some points lack in the provision of the straight warp yarns, which makes the fabric unstable.

SUMMARY OF THE INVENTION

An object of the present invention is to provide a method for producing multi-axial fabric of stable construction, while the fabric is highly compacted.

Another object of the present invention is to provide a low-cost weaving machine capable of producing a multi-axial fabric.

According to one aspect of the present invention, a multi-axial fabric is provided, comprising weft yarns and oblique warp yarns which run along directions which are different from each other and which are inclined with respect to a direction of the weft yarns to provide locations where the oblique warp yarns are crossed with each other so that said weft yarns and said oblique warp yarns are, at substantially all of said locations, interwoven with each other to construct a triaxial fabric, and straight warp yarns which run along a direction which is transverse to the direction of the weft yarns so that said straight yarns are, from at least one outer side along the thickness of the fabric, interwoven with the weft yarns which are interwoven with said oblique warp yarns to construct the triaxial fabric.

According to a second aspect of the present invention, a shedding device is provided for a weaving machine for producing multi-axial fabric having oblique warp yarns of different directions and weft yarns as well as straight warp yarns, said shedding device comprising:

first heddles arranged as opposite arrays for guiding the oblique warp yarns;

first shedding means for obtaining reciprocating movement of the heddle in the respective arrays to create a shed for receiving a weft yarn;

means for obtaining alternate, opposite weft-wise movement of the opposite arrays of the first heddles upon the completion of the shedding operation by the first shedding means for allowing that the oblique warp yarns and the weft yarn are interwoven with each other to create a triaxial fabric;

second heddles for guiding straight warp yarns at locations on one side of the first heddles adjacent to a cloth fell; and second shedding means for obtaining reciprocating movement of the second heddles so that the straight warp yarns are interwoven with respect to the weft yarn.

BRIEF DESCRIPTION OF THE ATTACHED DRAWINGS

Figure 3:
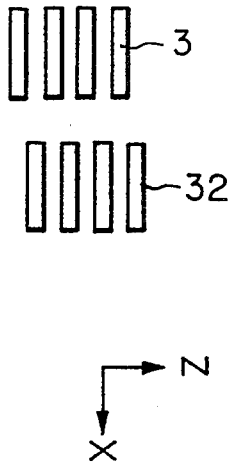

FIG. 3 schematically illustrates a relationship between upper and lower arrays of the heddles.

Figure 1:
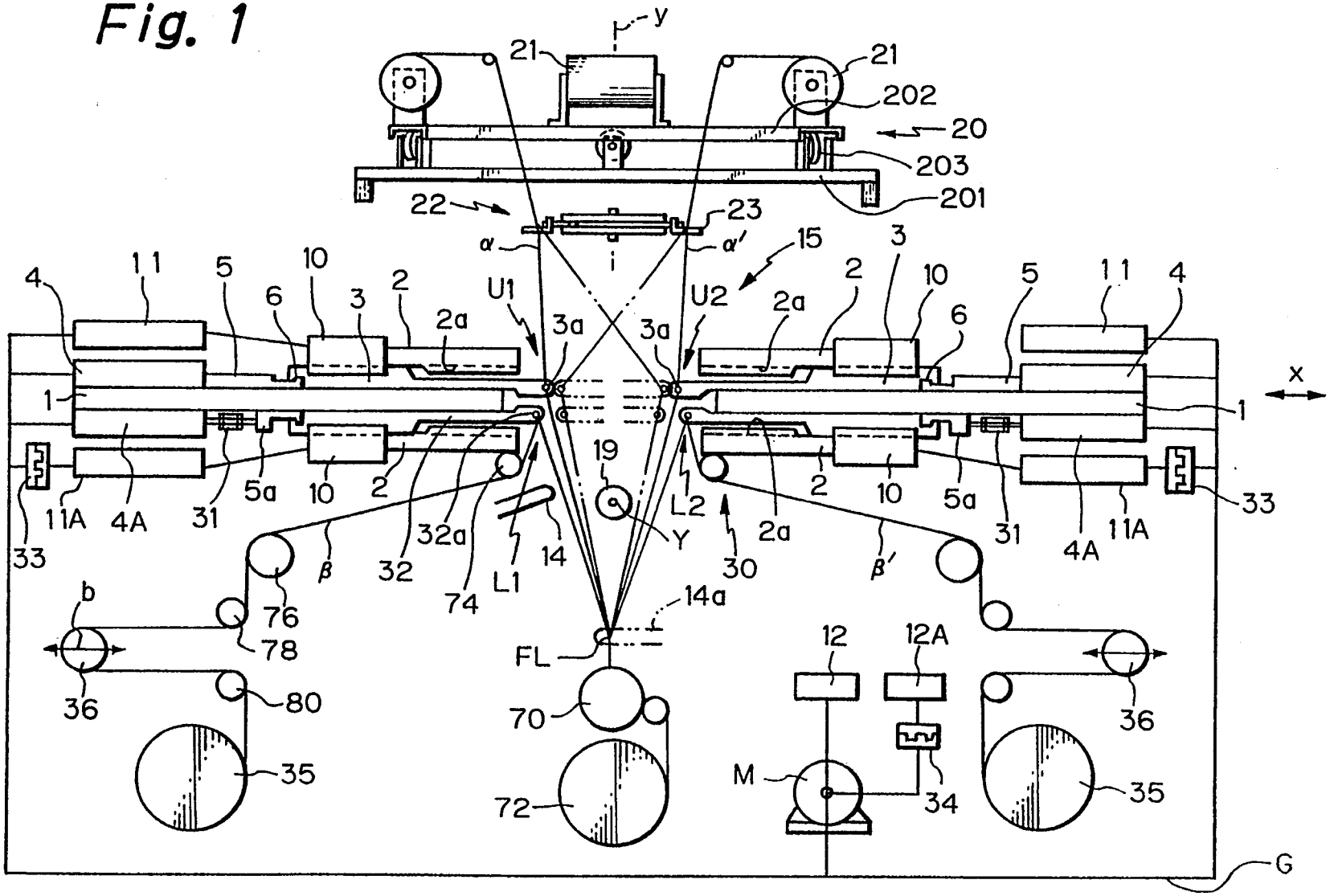
FIG. 1 is a schematic view of a weaving machine for producing a multi-axial fabric according to the present invention.
Figure 4:
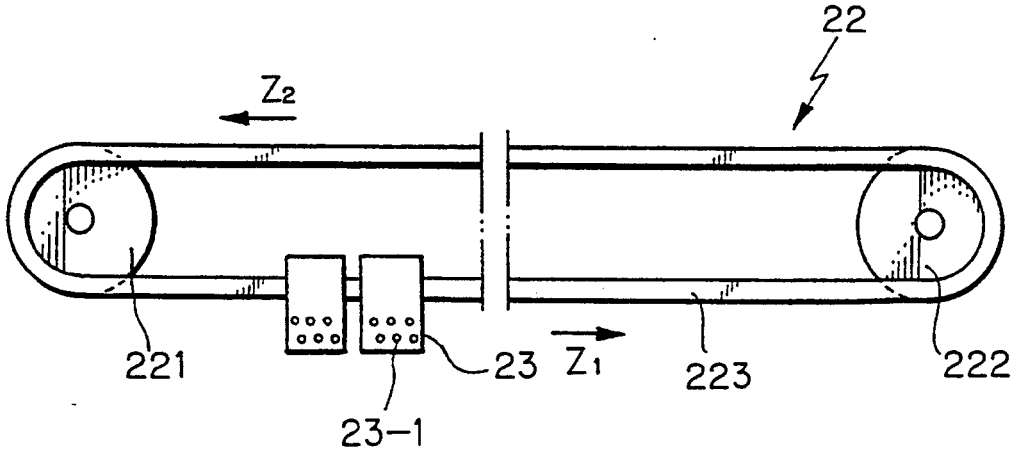

FIG. 4 illustrates a traverse mechanism of oblique warp yarns in FIG. 1.

Figure 5B:
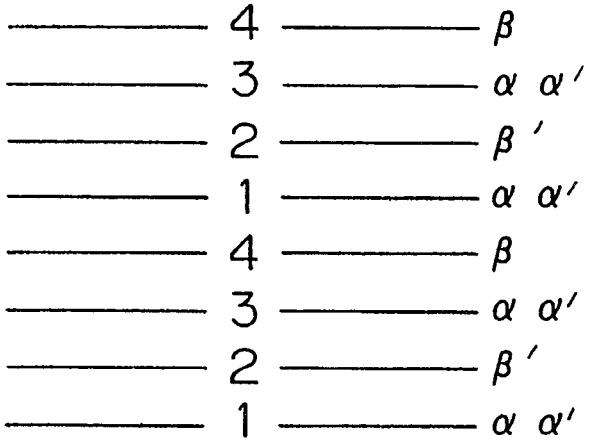
Figure 5A:
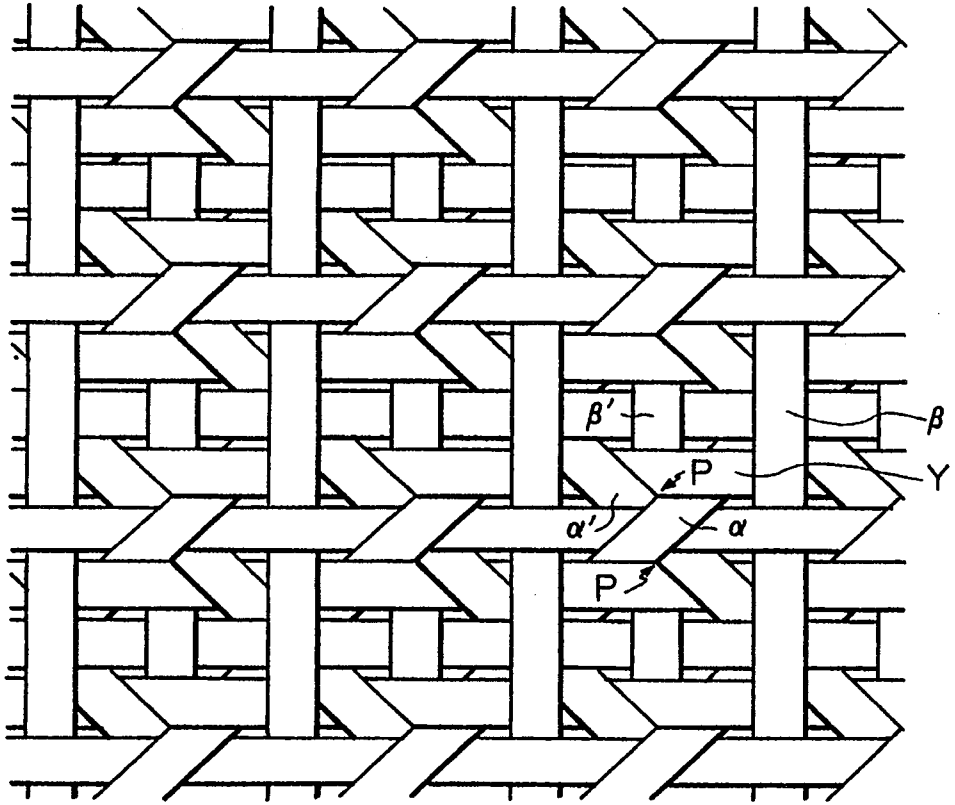

FIGS. 5(*a*) and 5(*b*) show a first example illustrating a construction of multi-axial fabric according to the present invention and the production timing therefore.

Figure 6B:
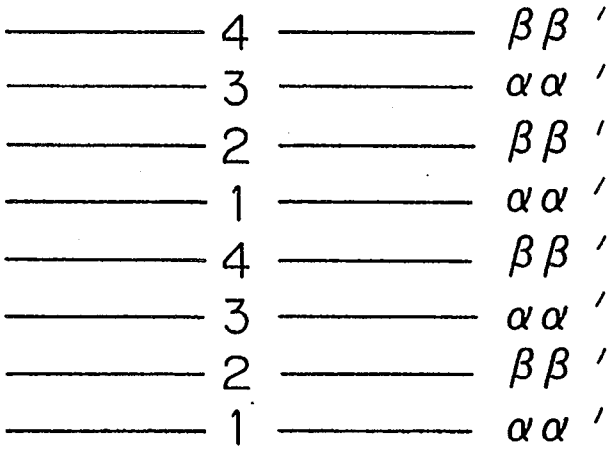
Figure 6A:
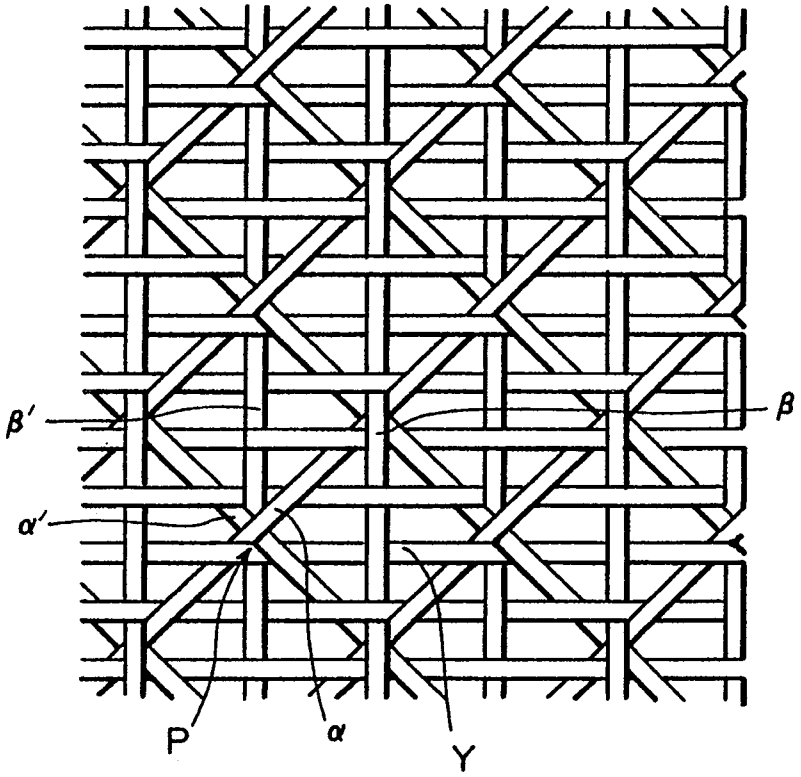

FIGS. 6(*a*) and 6(*b*) show a second example illustrating a construction of a multi-axial fabric according to the present invention and the production timing therefor.

Figures 7A, 7B:
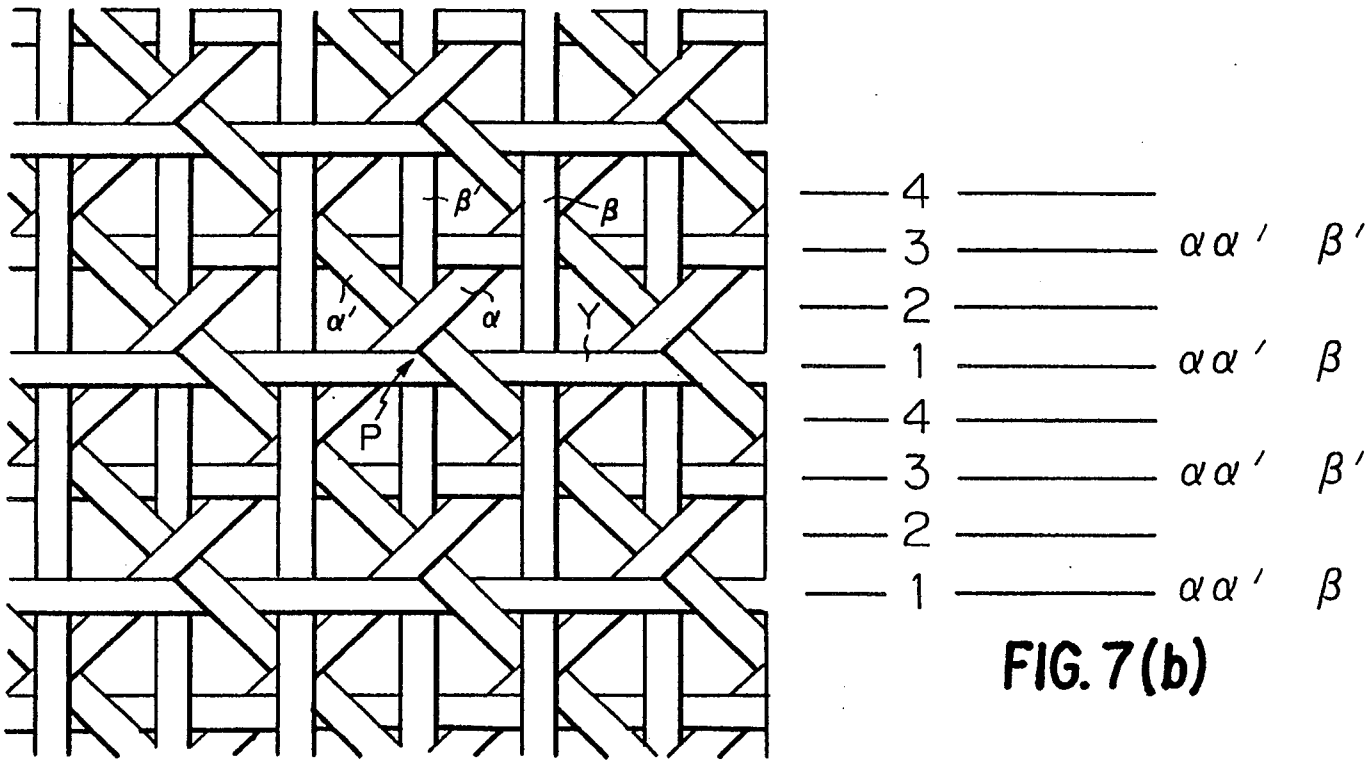

FIGS. 7(*a*) and 7(*b*) show a third example illustrating a construction of a multi-axial fabric according to the present invention and the production timing therefor.

Figure 8B:
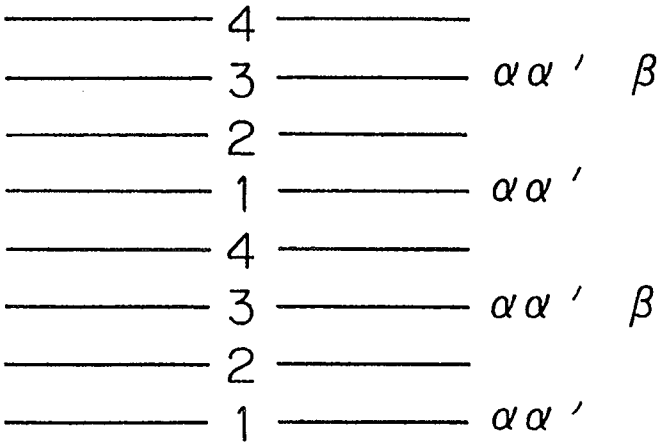
Figure 8A:
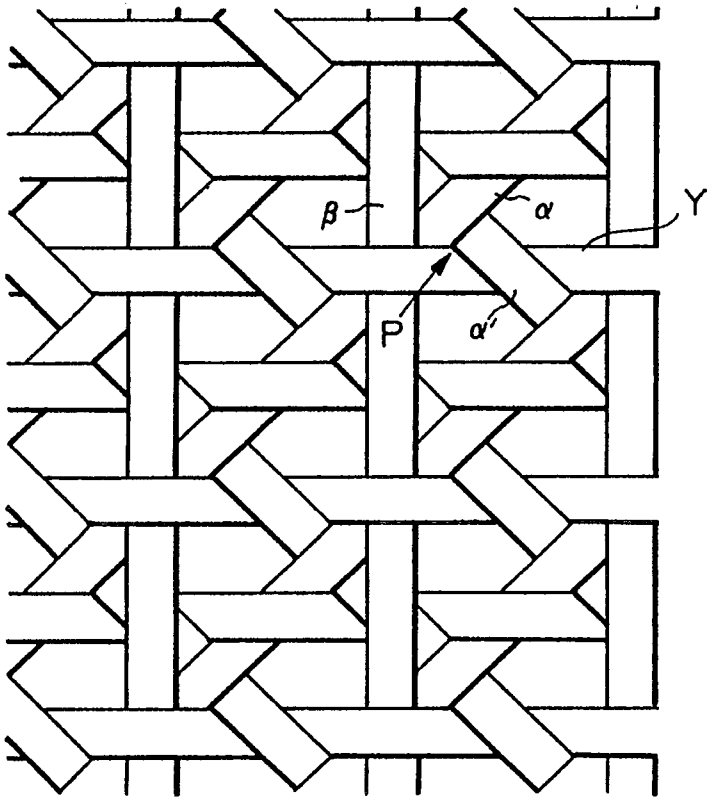

FIGS. 8(*a*) and 8(*b*) show a fourth example illustrating a construction of a multi-axial fabric according to the present invention and the production timing therefor.

Figure 9B:
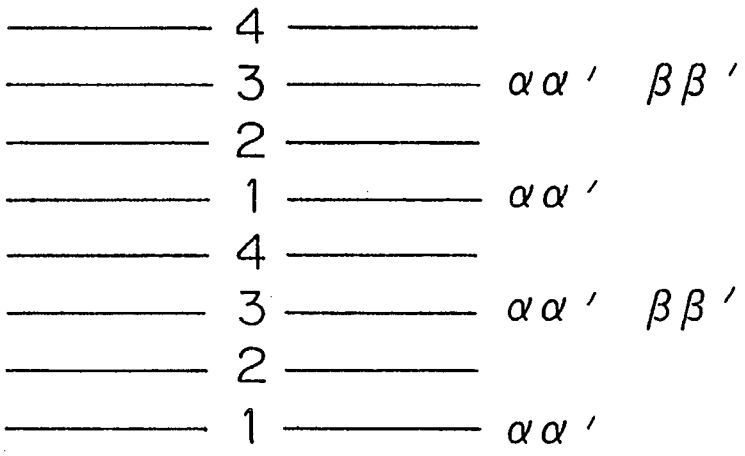
Figure 9A:
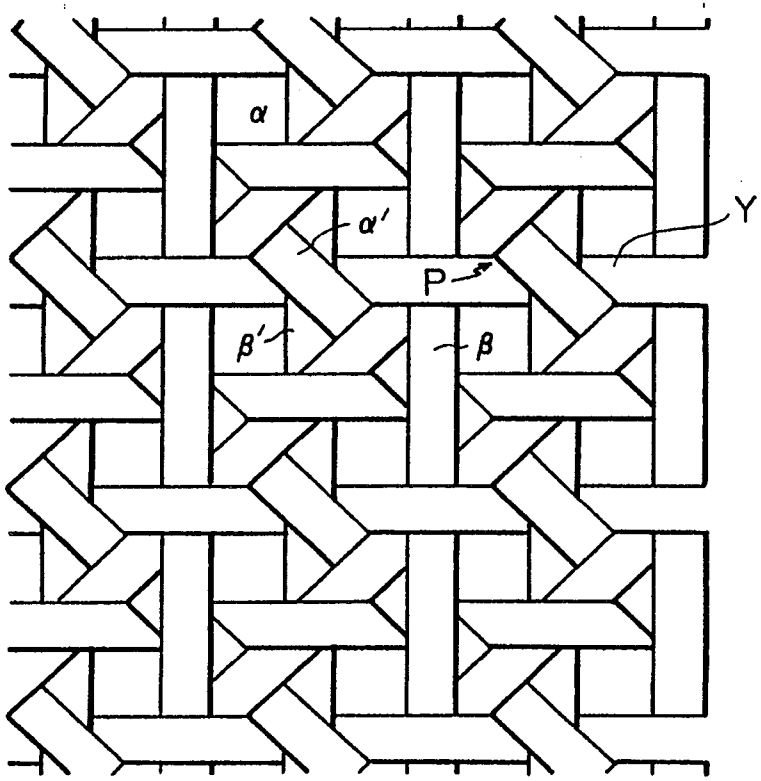

FIGS. 9(*a*) and 9(*b*) show a fifth example illustrating a construction of a multi-axial fabric according to the present invention and the production timing therefor.

Figure 10B:
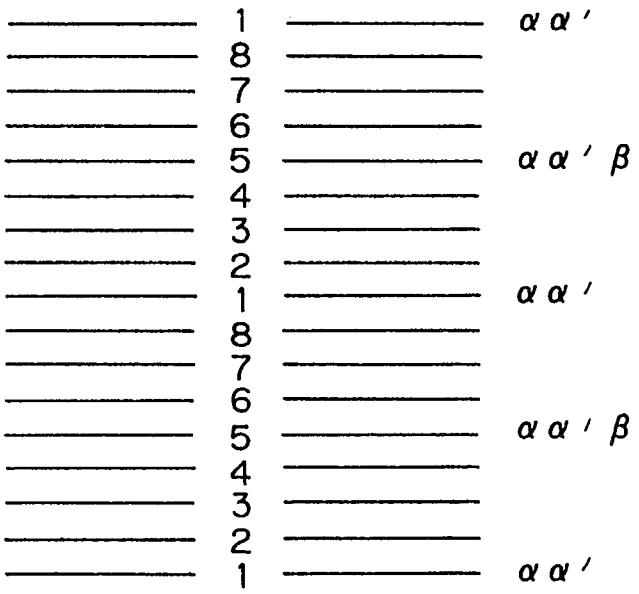
Figure 10A:
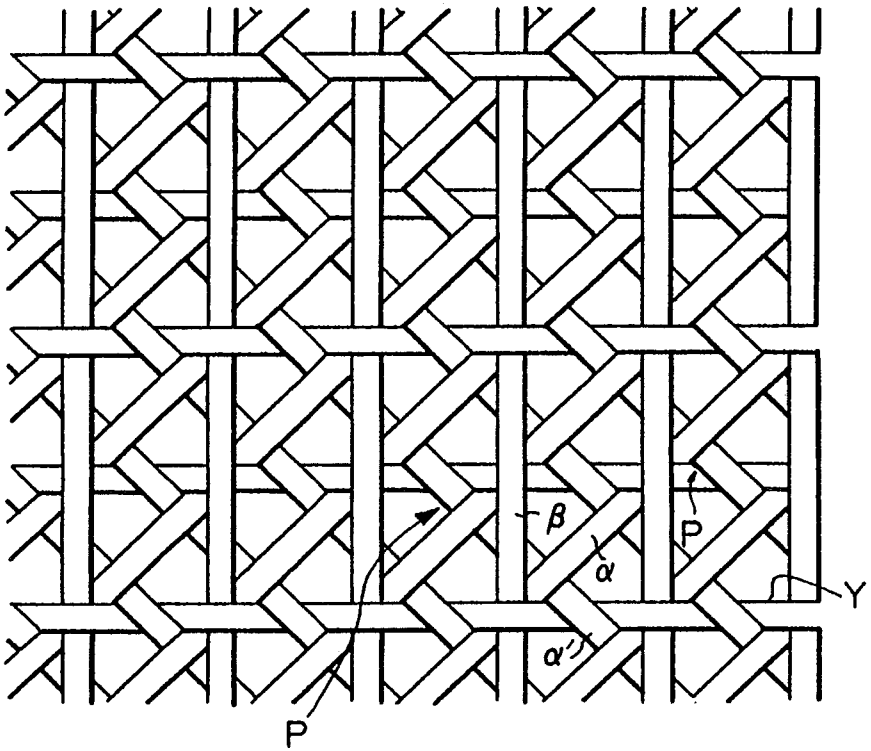

FIGS. 10(*a*) and 10(*b*) show a sixth example illustrating a construction of a multi-axial fabric according to the present invention and the production timing therefor.

FIGS. 11(*a*) and 11(*b*) show a seventh example illustrating a construction of a multi-axial fabric according to the present invention and the production timing therefor.

Figures 11A, 11B:
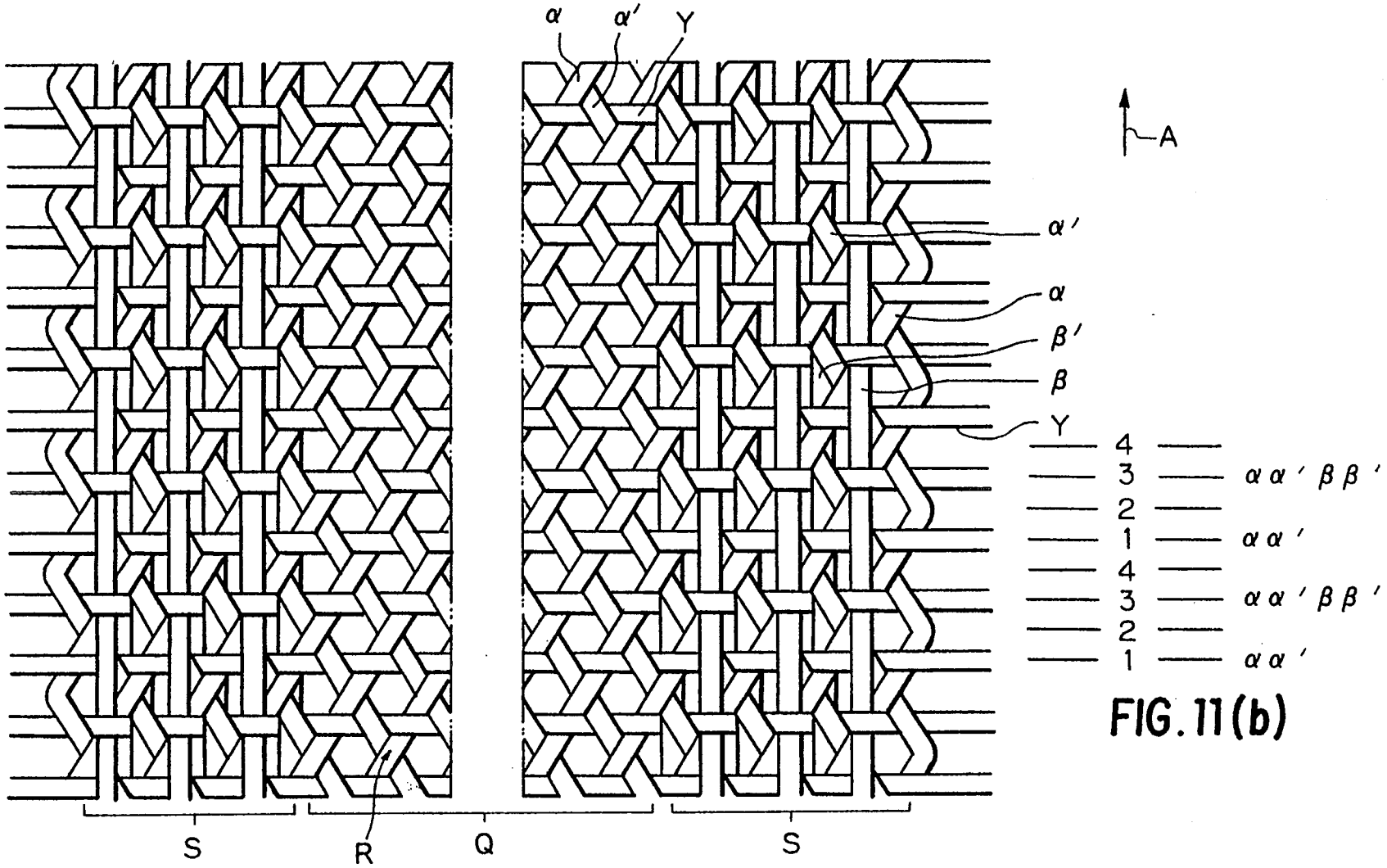
Figure 12:
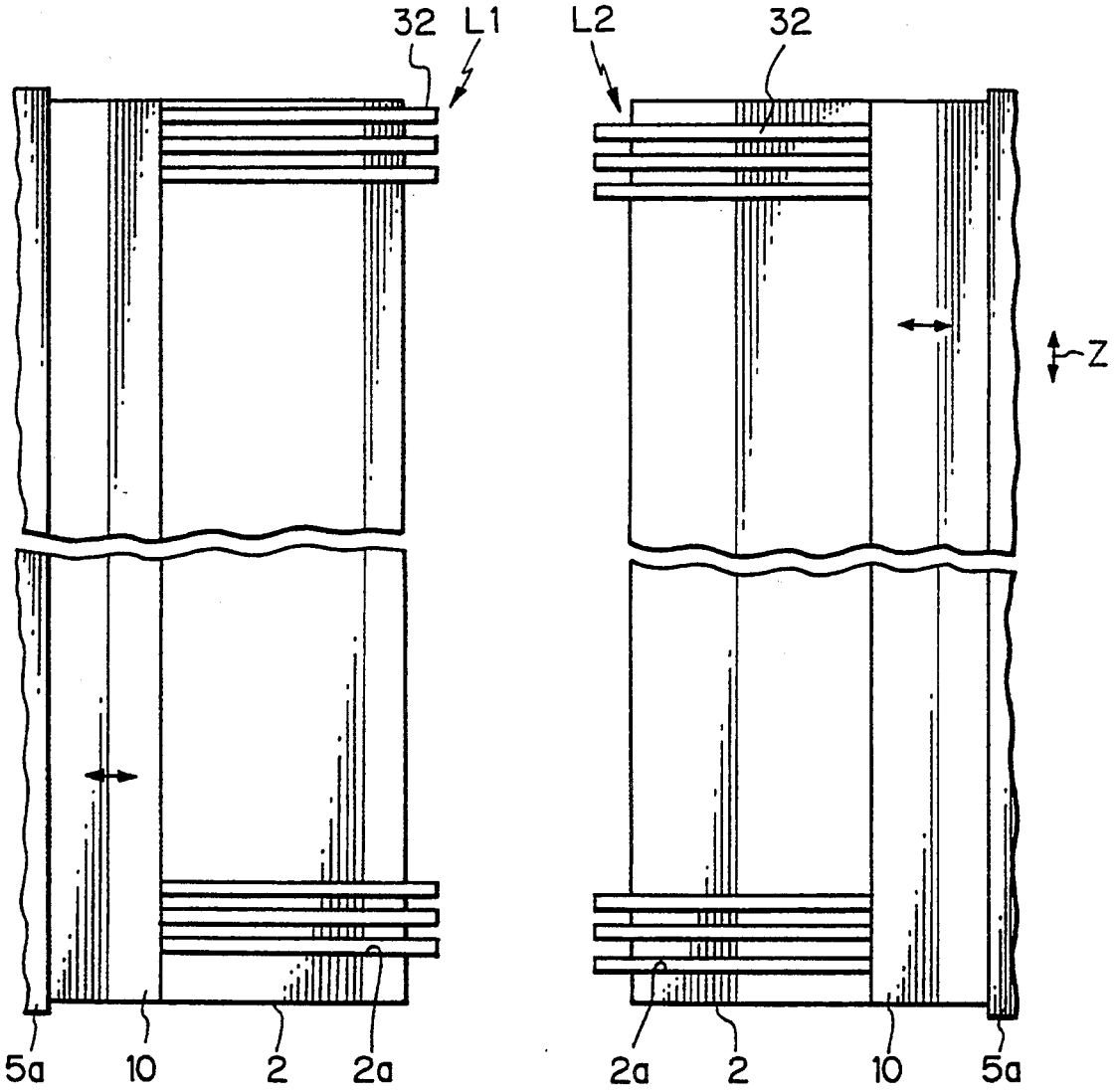

FIG. 12 shows a plan view of arrays of heddle for weaving the fabric in FIG. 11.

Figures 13A, 13B:
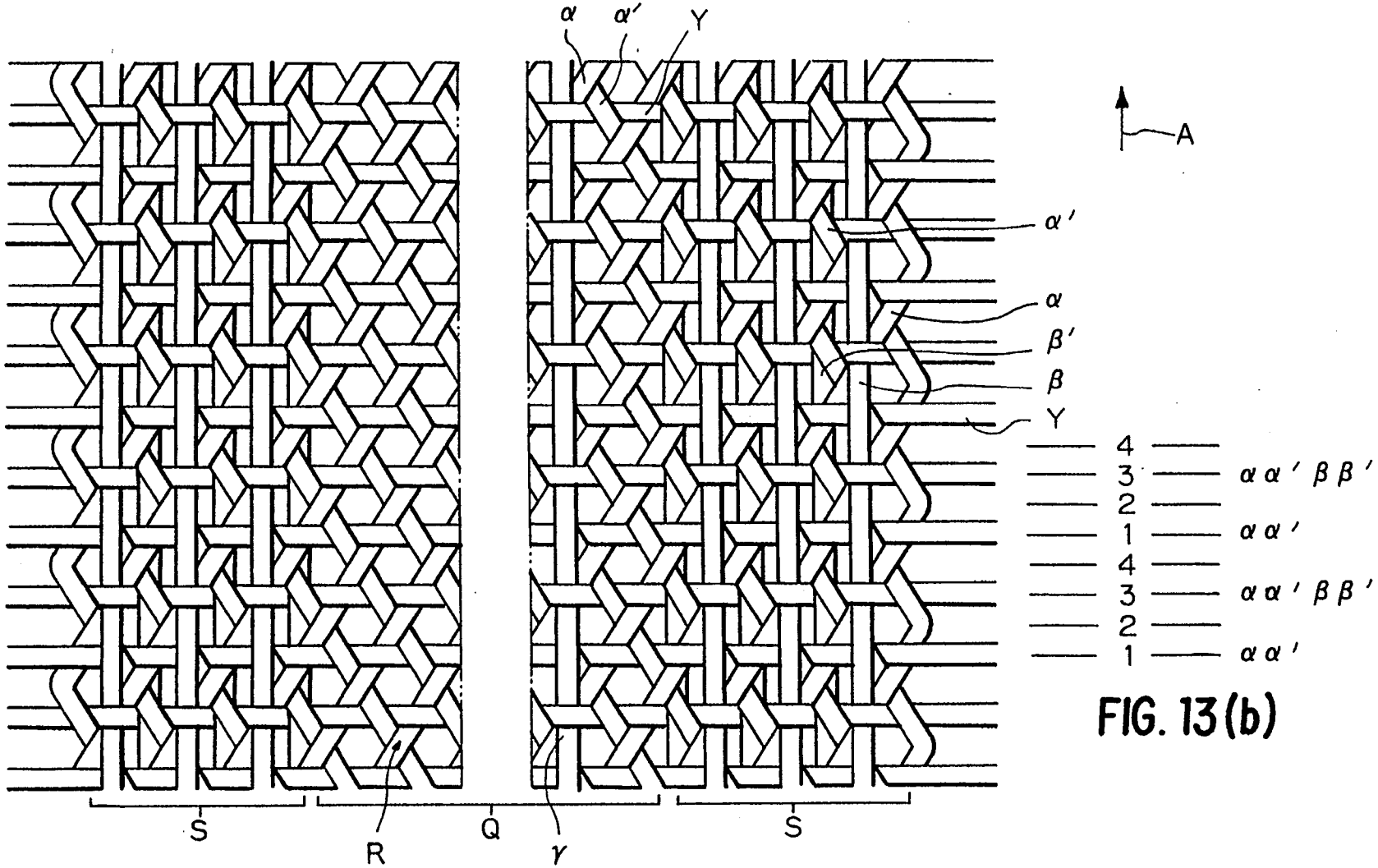

FIGS. 13(*a*) and 13(*b*) show another example of the construction of a multi-axial fabric according to the present invention and the production timing therefor.

DESCRIPTION OF PREFERRED EMBODIMENTS

Figure 2:
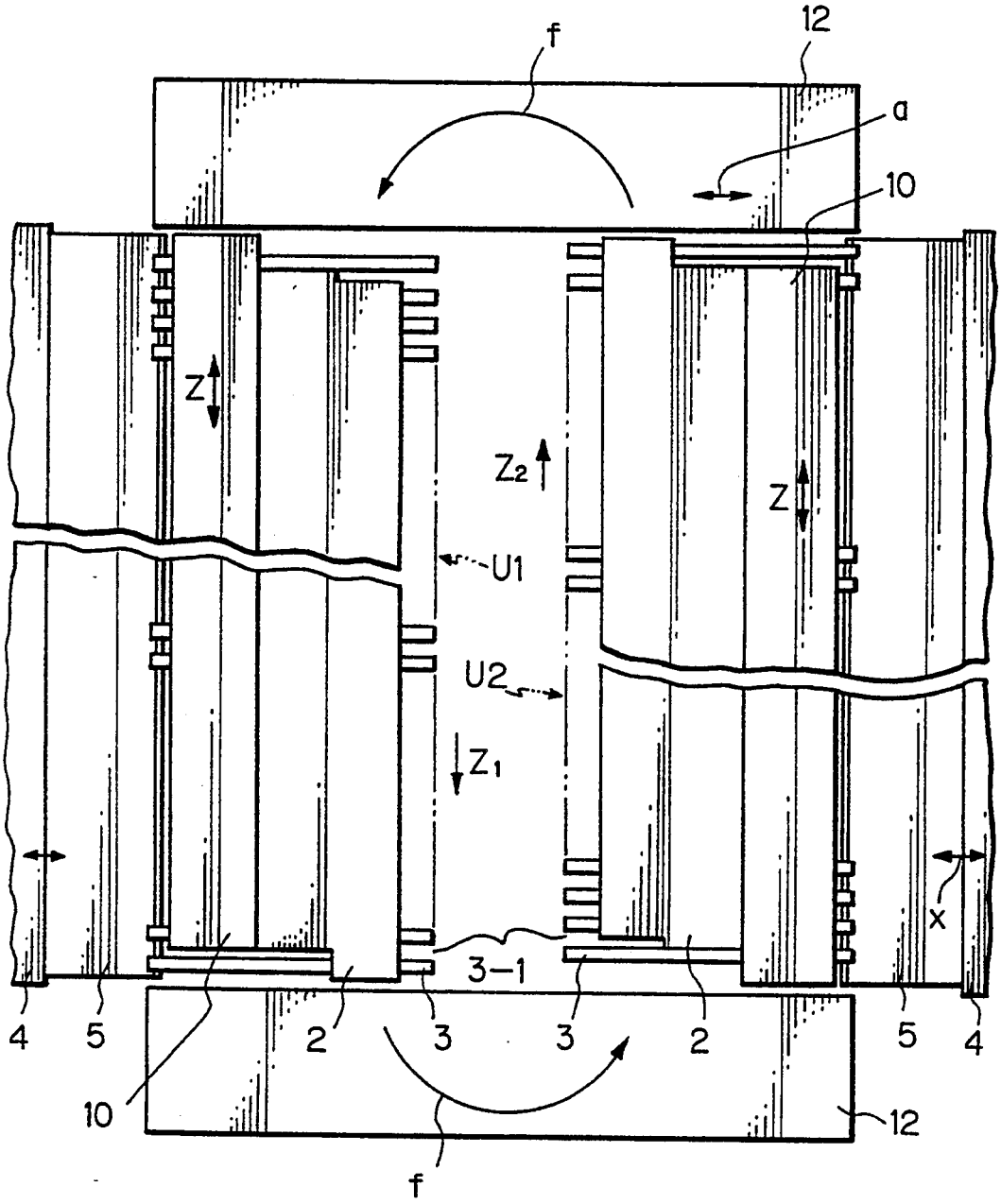
FIG. 2 is a plan view of arrays of heddles in FIG. 1.

Referring to FIGS. 1 to 4, a reference numeral 15 denotes a first shedding device for oblique warp yarns which is substantially similar to a conventional shedding device for triaxial fabric. The device 15 includes a guide plate 1 which is fixed to a frame. Mounted on the guide plate 1 is a groove plate 2 which forms a plurality grooves 2*a* which extend in a direction as shown by an arrow x, which is transverse to a weft wise direction z, as shown in FIG. 2. The grooves 2*a* are spaced apart along the weft-wise direction so that gaps are created between adjacent grooves 2*a*. A plurality of heddles 3 for sets of oblique warp yarns are arranged in the grooves 2*a*, respectively so that they are reciprocated along the direction x. Each of the heddles 3 forms, at its free end, a guide opening 3*a* for threading a corresponding oblique warp yarn. As shown in FIG. 2, the heddles 3 form two groups U1 and U2 which are opposite in the direction x. As shown in FIG. 2, the heddles 3 are alternately arranged between the groups U1 and U2, so that the heddles 3 in one groups U1 or U2 are located in spaces 3-1 between the heddles which are adjacent with each other when the heddles 3 between the groups U1 and U2 are moved toward each other so that they are crossed for creating the shed. It should be noted that the pitch of the heddles 3 (a distance between the heddles 3 located adjacent with each other in one group U1 or U2) is as small as possible. The pitch is, for example, such that the heddles 3 of number of 96 or more are arranged in a width of 10 cm along the direction z in FIG. 2.

Reciprocating mechanisms 4, which are only schematically shown, are provided for the heddles 3 of the groups U1 and U2, respectively. Each of the reciprocating mechanisms 4 has a cam (not shown) and a reciprocating plate 5 which cooperates with the cam for obtaining reciprocating movement along the direction x. The reciprocating plate 5 has, at its end remote from the reciprocating mechanism 4, a hook 6 which is capable of engaging the corresponding heddle 3 for transmitting the reciprocating movement of the reciprocating plate 5 to the corresponding heddle 3. As well known, the heddles 3 are movable along the weft-wise direction z so as to create the lateral, stepwise movement of the oblique warp yarns for an amount corresponding to a pitch of the heddles. Furthermore, movable reciprocating bars 10 are provided, so that, upon a completion of the retracting movement of the heddles 3, engagement is obtained between heddles 3 and the bars 10, which permits the heddles in the group to be laterally moved along the weft-wise direction z for a predetermined pitch.

In FIG. 1, a reference numeral 11 denotes a heddle drive mechanism for obtaining a stepwise, weft-wise movement of the heddles 3 in such a manner that the heddles 3 in the group U1 moves in one direction as shown by an arrow z1 in FIG. 2, while the heddles 3 in the other group U2 moves in the opposite direction as shown by an arrow z2. Furthermore, a heddle transfer mechanism 12 is provided for obtaining transferring movement of a heddle 3 between the groups U1 and U2. Namely, during the movement of the heddles 3 along the axis z, the heddles 3 in the groups U1 and U2 located at the front ends in the direction of the movement along the axis z are transferred to the rear ends to the opposite groups along trajectories as shown by arrows f in FIG. 2. Due to the provision of such a transferring mechanism, an endless movement of the heddles 3 between the opposite groups U1 and U2 is realized.

A rotating motor M is a rotating movement source, and is drivingly connected, via a gear train G, to the reciprocating mechanism 4, the heddle drive mechanism 11 and the heddle transfer mechanism 12 for obtaining designated movements thereof.

Above the arrays U1 and U2 of the heddles 3 for the oblique warp yarns, a rotary creel 20 is arranged so that it is rotated about the vertical axis y. The rotary creel 20 is provided with a fixed support plate 201, on which a rotary plate 202 is rotatably arranged via rollers 203. The rotary plate 202 is connected, via a transmission mechanism (not shown), to an electric motor M for imparting a stepwise rotating movement to the rotary plate 202. Mounted to the rotary plate 202 are a plurality of circumferentially spaced drums 21, on which oblique warp yarns are wound under a warped condition. The drums 21 are connected to a drive mechanism for supply of the warp yarns.

In place of employing the above mentioned rotary creel 20, a conventional creel structure can be used, which has a plurality of fixed support members for packages for individual warp yarns.

Arranged between the each of the rotary creel 20 and the arrays of the heddles 3 is a traverse device 22 for the oblique warp yarns. The traverse device 22 is, as shown in FIG. 4, provided with a pair of spaced apart pulleys 221 and 222, a belt 223 looped around the pulleys 221 and 222, and guide plates 23 connected to the belt 223 so that they are spaced apart with each other. Each of the guide plates 23 is formed with a plurality of guide openings 23-1 for threading the oblique warp yarns. The pulleys 221 and 222 are subjected to intermittent rotating movement in such a manner that a weft-wise movement of the guide plates 23 as shown by arrows z1 and z2 is obtained in accordance with the weft-wise movement of the heddles 3.

Arranged below the beating device 14 are a set of a guide rollers 70 and a beam 72 for winding the fabric.

The details of the reciprocating mechanism 4, a heddle drive mechanism 11 and the heddle transfer mechanism 12 are substantially the same as those described in Japanese Unexamined Patent Publication No. 60-54417 or U.S. Pat. Nos. 4,013,103; 4,105,052; 4,140,156. Namely, the heddles 3 in the one group U1 guide the oblique warp yarns $\alpha$, while the heddles 3 in the opposite group U2 guide the oblique warp yarns $\alpha'$. The heddles 3 in one group, for example the group U1, is moved along the weft-wise z1 (FIG. 2) by means of the movable reciprocating bar 10 of the heddle drive mechanism 11. Next, the heddle reciprocating mechanism 4 is operated so that the heddles 3 in the opposite groups U1 and U2 are moved toward each other in such a manner that the oblique warp yarns $\alpha$ held by the heddles 3 in the first group U1 are crossed with the oblique warp yarns $\alpha'$ held by the heddles 3 in the first group U2 as shown by phantom lines, so that a shed is created. Then, a weft inserting operation is carried out by means of rapiers 19, so that a weft yarn Y is introduced into the shed, and then a beater 14 is extended into the shed along the weft-wise direction toward the cloth fell FL to a position as shown by a phantom line 14*a*. Then, the beater 14 is extracted along the axis z, and the heddles 3 in the both of the groups U1 and U2 are returned to their retracted positions as shown by solid lines, so that the oblique warp yarns $\alpha$ and $\alpha'$ are returned to the non-crossed positions as shown by the solid lines.

In the next phase, the heddles 3 in the second group U2 are, as shown in FIG. 2, moved along the a weft-wise in a direction as shown by an arrow z2 which is opposite to the direction z1 of the movement of the heddle in the first group U1 in the preceding phase. A shedding operation of the oblique warp yarns $\alpha$ and $\alpha'$ by means of the opposite movement of the heddle 3 between the groups U1 anti U2, an weft inserting operation by means of the rapiers 19, and a beating operation by means of the beater 14 are followed.

During the above weaving operation, as will be clear from the above, opposite weft wise movements of the heddles 3 are obtained between the first and second groups U1 and U2. A heddle 3 located at the leading end in one group in the direction of the movement is transferred to the tail end in the opposite group as shown by the arrow f in FIG. 2 by means of the operation of the heddle transfer mechanism 12 in the same manner as described in U.S. Pat. No. 4,013,103.

During the weaving operation, it is desirable that, after the weft inserting phase, the condition that the weft yarn Y is pressed by means of the beater is maintained, while the fabric is wound for an amount corresponding a pitch of the weft yarns, so that the cloth fell FL is correspondingly lowered, and then the retracting movements of the heddles 3 and the beater 14 are commenced. This is advantageous in that the beating operation of the weft yarn T toward the cloth fell FL is cushioned, thereby preventing the oblique warp yarns $\alpha$ and $\alpha'$ from being subjected to an impulsive tension.

According to the present invention, in addition to the first shedding device 15 for the oblique warp yarns, a second shedding device 30 for additional sets of straight warp yarns is arranged slightly below the first shedding device 15. The second shedding device 30 is constructed by heddles 32, which constructs a pair of opposite groups L1 and L2, as similar to the groups U1 and U2 in the first shedding device 15. The second shedding device 30 is further provided with a reciprocating mechanism 4A, a heddle drive mechanism 11A, and a heddle transfer mechanism 12A, which are similar to the mechanisms 4, 11 and 12, respectively in the first shedding device 15, except that turn buckles 31 are arranged between the reciprocating plate 5A of the reciprocating mechanism 4A for obtaining desirably adjusted positions of the heddles 32, and that clutches 33 and 34 are arranged in the drive train between the rotating motor M and the heddle drive mechanism 11*a*, and between the rotating motor M and the heddle transfer mechanism 12A, respectively. To create the quartaxial fabric according to the present invention, these clutches 33 and 34 are disengaged, so that the operation of the heddle drive mechanism 11 and the heddle transfer mechanism 12A are canceled, which causes the heddles 32 in the both of the groups L1 and L2 to be maintained unmoved along the weft-wise direction z1 and z2, which permits the warp yarns $\beta$ controlled by the heddles 32 to be only moved along the direction x transverse to the weft-wise direction.

As shown in FIG. 1, the upper arrays U1 and U2 of the heddles 3 for the oblique warp yarns $\alpha$ and $\alpha'$ and the lower arrays L1 and L2 of the heddles 32 for the straight warp yarns $\beta$ and $\beta'$ are arranged so that they are opposite with each other and so that, as shown in FIG. 3, a phase difference corresponding to the heddle pitch is created between arrays U1 and U2 of the heddles 3 and arrays L1 and L2 of the heddles 32. This construction allows that, upon the movement of the second heddles 32 along the axis x for creating the shed between the straight warp yarns $\beta$ and $\beta'$, the heddles 32 can be passed through the spacing formed between the straight warp yarns $\beta$ and $\beta'$, which are located adjacent with each other, which makes it possible that the straight warp yarns $\beta$ and $\beta'$ to be interwoven with the weft yarns Y.

As shown in FIG. 1, guide rollers 74 are arranged below the groove plates 2 for guiding the warp yarns $\beta$ and $\beta'$ to the heddles 32. The warp yarns $\beta$ and $\beta'$ are directed, via guide rollers 76, correction control rollers 36 and guide rollers 80, to beams 35 for the straight warp yarns.

When it is necessary to cause the warp yarns $\beta$ and $\beta'$ to be the straight ones, the clutches 33 and 34 are disengaged, and the turnbuckles 31 are adjusted so that the warp yarns $\beta$ and $\beta'$ guided by heddles 32 in the groups L1 and L2 are located outwardly of the warp yarns $\alpha$ and $\alpha'$ guided by the heddles 3 in the groups U1 and U2, respectively, as will be seen from FIG. 1. The straight warp yarns $\beta$ and $\beta'$, from the supply device 35, are threaded through guide openings 32*a* of the heddles 32, and, by means of the operation of the reciprocating mechanism 4A, are moved between positions where the straight warp yarns $\beta$ and $\beta'$ are located outside of the oblique warp yarns $\alpha$ and $\alpha'$, and positions where the straight warp yarns $\beta$ and $\beta'$ are located inside of the oblique warp yarns $\alpha$ and $\alpha'$, so that the shed is created, to which the weft yarns Y are inserted. In accordance with the movement of the heddles 32 along the direction x transverse to the weft-wise direction, the yarn length correction rollers 36 are moved along the same direction as shown by arrows b, so that a constant tension of the warp yarns $\beta$ and $\beta'$ is substantially maintained.

It should be noted that an engagement of the clutches 33 and 34 causes the lower, second heddles 32 in the groups L1 and L2 to be oppositely moved along the weft-wise direction in synchronism with the upper, first heddles 3 in the groups U1 and U2. In this case, the heddles 32 serve as a shedding mechanism for oblique warp yarns from the creel mechanism 20 to create doubled triaxial fabric. Namely, the oblique warp yarns from the creel device are threaded via the eyelet 32*a* of the heddles 32 toward the cloth fell FL.

In the above construction of the weaving machine, the clutches 33 and 34 are disengaged when it is necessary that the second shedding mechanism 30 is used for obtaining warp yarns which are transverse to the weft yarns Y. Various types of fabrics as produced will now be explained. FIG. 5-(*a*) shows a first example of a construction of the fabric. FIG. 5-(*b*) illustrates timing diagram illustrating how warp yarns are subjected to a shedding movement at times during one complete cycle of a weaving operation. Namely, according to this example, at time 1, the oblique warp yarns $\alpha$ and $\alpha'$ are subjected to a shedding operation by means of the opposite movement of the heddles 3 between the groups U1 and U2 to create a shed, which is followed by a weft insert operation of the weft yarn Y, so that the oblique warp yarns $\alpha$ and $\alpha'$ are interwoven with the weft yarn Y, and the heddles 3 are retracted. Then, the one pitch weft-wise movement of the oblique warp yarns $\alpha$ is obtained along the direction as shown by the arrow z1 in FIG. 2 by moving the heddles 2 in the group U1 by the heddle drive mechanism 11. Then, at time 2, only the second heddles 32 in the group L2 supporting the straight warp yarns $\beta'$ are extended, which is followed by a weft insert operation of the weft yarn Y, so that straight warp yarns $\beta'$ are interwoven with the weft yarn Y, and the heddles 32 in the group L2 are retracted. Then, a one pitch weft-wise movement of the oblique warp yarns $\alpha'$ is obtained in a direction as shown by the arrow z2 in FIG. 2 by moving the heddles 2 in the group U2 by the heddle drive mechanism 11. At time 3, as similarly done at the time 1, the oblique warp yarns $\alpha$ and $\alpha'$ are subjected to a shedding operation, which is followed by a weft insert operation of the weft yarn Y, so that the oblique warp yarns $\alpha$ and $\alpha'$ are interwoven with the weft yarn Y, and the heddles 3 in the groups U1 and U2 are retracted, respectively. Then, the one pitch movement of the oblique warp yarns $\alpha$ is obtained along the axis z as in a direction as shown by the arrow z1 in FIG. 2. Finally, at time 4, only the second heddles 32 in the group L1 supporting the straight warp yarns $\beta$ are extended, which is followed by a weft insert operation of the weft yarn Y, so that straight warp yarns $\beta$ are interwoven with the weft yarn Y, and the heddles 32 in the group L1 are retracted, so that a weaving operation of one cycle is completed, and this cycle is repeated. As a result, a quartaxial fabric is obtained, where oblique warp yarns $\alpha$ and $\alpha'$ are interwoven with weft yarns Y as shown, for example, at point P, so as to construct a triaxial fabric, and, the straight weft yarns $\beta$ and $\beta'$ are located on the opposite (upper and lower) sides of the triaxial fabric points P, while the straight weft yarns $\beta$ and $\beta'$ are interwoven to the weft yarns Y which are interwoven to the oblique warp yarns at the adjacent points P.

According to this embodiment, for all of the points where the oblique warp yarns $\alpha$ and $\alpha'$ are crossed with each other, the oblique warp yarns $\alpha$ and $\alpha'$ are interwoven with the weft yarns Y to create a triaxial fabric, and, the straight warp yarns $\beta$ and $\beta'$ are interwoven with the weft yarns interwoven with the oblique warp yarns, which allows the produced fabric to have an improved dimensional stability.

FIG. 6-(*a*) shows a second example of the quartaxial fabric according to the present invention. In order to obtain this fabric, as shown in FIG. 6-(*b*), at time 1, the heddles 3 in the opposite groups U1 and U2 are extended so that the oblique warp yarns $\alpha$ and $\alpha'$ are moved to form a shed, to which a weft yarn is inserted. Then, the heddles 3 together with the oblique warp yarns $\alpha$ and $\alpha'$ are retracted, and a one pitch weft-wise movement of the oblique warp yarns $\alpha$ is obtained. At time 2, the second heddles 32 in both of the groups L1 and L2 are extended so that the straight warp yarns $\beta$ and $\beta'$ are crossed with each other as to form a shed, to which a warp yarn Y is inserted, and the heddles 32 together with the straight warp yarns $\beta$ and $\beta'$ are retracted. Then, at time 3, the oblique warp yarns $\alpha$ and $\alpha'$ are again moved to form a shed, to which a weft yarn is inserted. Then, the heddles 3 together with the oblique warp yarns $\alpha$ and $\alpha'$ are retracted, and a one pitch weft-wise movement of the oblique warp yarns $\alpha'$ is obtained. At time 4, the second heddles 32 in both of the groups L1 and L2 are again extended so as to cause the warp yarns $\beta$ and $\beta'$ to be crossed to form a shed, to which a warp yarn Y is inserted, and the heddles 32 together with the warp yarns $\alpha$ and $\beta'$ are retracted. Namely, the structure in FIG. 6 is different from that in FIG. 5 in that the straight warp yarns $\beta$ and $\beta'$ are alternately interwoven with the weft yarns Y, while the straight warp yarns $\beta$ and $\beta'$ are located on the respective (upper and lower) sides with respect to the triaxial fabric points P.

FIG. 7(*a*) shows another example of a construction of a fabric. In this example, as shown in FIG. 7(*b*), at time 1, the oblique warp yarns $\alpha$ and $\alpha'$ and straight warp yarns $\beta$ are extended to create a shed, then a weft inserting operation is carried out, the oblique warp yarns $\alpha$ and $\alpha'$ are retracted, and a one pitch weft-wise movement of the oblique warp yarns $\alpha$ is executed. At time 2, shedding of the warp yarns and weft insert movement are not performed, while a one pitch weft-wise movement of the oblique warp yarns $\alpha'$ is executed. At time 3, the oblique warp yarns $\alpha$ and $\alpha'$ and straight warp yarns $\beta'$ are extended to create a shed, then a weft inserting operation is carried out, the oblique warp yarns $\alpha$ and $\alpha'$ and retracted, and a one pitch weft-wise movement of the oblique warp yarns $\alpha$ is executed. At time 4, no warp yarns are moved, while a one pitch weft-wise movement of the oblique warp yarns $\alpha'$ is executed. In this case, at the triaxial fabric points P, the oblique warp yarns $\alpha$ and $\alpha'$ the straight warp yarn $\beta$ or $\beta'$ are interwoven to the weft yarns Y, and the straight warp yarns $\beta$ and $\beta'$ are located on the respective (upper and lower) sides of the triaxial fabric points, although, to the weft yarns Y constructing the triaxial fabric points P, the straight warp yarns $\beta$ or $\beta'$ are interwoven.

In this embodiment in FIG. 7(*a*), at all of the points as shown by P, where the oblique warp yarns $\alpha$ and $\alpha'$ and the weft yarns Y are interwoven to create a triaxial fabric, the straight warp yarns $\beta$ and $\beta'$ are also interwoven to the weft yarns Y constructing the triaxial fabric, thereby allowing to obtain a stable multi-axial fabric.

In an example in FIGS. 8(*a*) and 8(*b*), only one kind of straight warp yarn $\beta'$ is used. At time 1, the oblique warp yarns $\alpha$ and $\alpha'$ are crossed, then the weft yarn Y is inserted, and oblique warp yarns $\alpha$ and $\alpha'$ are retracted. At time 2, no crossing movement of the warp yarns nor weft inserting operation is done. At time 3, the oblique warp yarns $\alpha$ and $\alpha'$ as well as the straight warp yarns $\beta'$ are crossed, and then the weft yarn Y is inserted, and oblique warp yarns $\alpha$ and $\alpha'$ as well as the straight warp yarns $\beta'$ are retracted. At time 2, both of the crossing movement of the warp yarns and the weft inserting operation are not done. In this construction, the oblique warp yarns $\alpha$ and $\alpha'$ and weft yarns Y are interwoven at points P, and, to the weft warns Y interwoven to the oblique warp yarns $\alpha$ and $\alpha'$, the straight warp yarns Y are interwoven.

FIGS. 9(*a*) and 10(*b*) show another example of the fabric according to the present invention. At time 1, the oblique warp yarns $\alpha$ and $\alpha'$ are crossed, the weft yarn is inserted, and the oblique warp yarns $\alpha$ and $\alpha'$ are retracted. At time 2, no crossing movement of the warp yarns nor a weft inserting operation is done. At time 3, the oblique warp yarns $\alpha$ and $\alpha'$ and straight warp yarns $\beta$ and $\beta'$ are crossed, and the warp yarn Y is inserted. At time 3, no crossing movement of the warp yarns nor a weft inserting operation is done. At time 4, the oblique warp yarns $\alpha$ and $\alpha'$ and straight warp yarns $\beta$ and $\beta'$ are crossed. In this construction, the oblique warp yarns $\alpha$ and $\alpha'$ and weft yarns Y are interwoven at points P, and, to the weft warns Y interwoven to the oblique warp yarns $\alpha$ and $\alpha'$, the straight warp yarns Y are interwoven.

FIGS. 10(*a*) and 10(*b*) show another example of the construction of the fabric, which is similar to that in FIGS. 8(*a*) and 8(*b*). But, in this example, the weft yarns are coarser. Namely, although the fabric has one cycle of eight times, no crossing movement of the warp yarns nor a weft inserting operation is done at times 2, 3, 4 and 6, 7 and 8. At time 1, the oblique warp yarns $\alpha$ and $\alpha'$ are crossed. At time 5, the oblique warp yarns $\alpha$ and $\alpha'$ as well as the straight warp yarns $\beta'$ are crossed.

In the construction of the fabrics shown in FIGS. 5 to 10, in every triaxial fabric portion P, an oblique warp yarn $\alpha$ is located below a weft yarn Y and above an oblique warp yarn $\alpha'$, while the oblique warp yarn $\alpha'$ is located above the weft yarn Y and below the oblique warp yarn $\alpha$, and the weft yarn Y is located below the oblique warp yarn $\alpha'$ and above the oblique warp yarn $\alpha$, so that a stable construction is obtained at the point P. In addition, to the weft yarn Y constructing the triaxial fabric portion P, a straight warp $\beta$ or $\beta'$ is interwoven, which allows the fabric to be highly stable, due to the increased degree of an interweave, which allows a directional uniformity in the strength to be improved.

FIGS. 11(*a*) and 11(*b*) show further another example of the multi-axial fabric according to the present invention, which is constructed from a central portion Q which is formed as a triaxial fabric constructed by two sets of oblique warp yarns $\alpha$ and $\alpha'$ of different directions and weft yarns Y, and edge (selvage) portions S which formed as a quartaxial fabric constructed by a triaxial fabric from the oblique warp yarns $\alpha$ and $\alpha'$ and weft yarns Y, and two sets of three straight warp yarns $\beta$ and $\beta'$ which are alternately arranged and which are interwoven with the triaxial fabric from it upper and lower sides. The oblique warp yarns $\alpha$ are located below the weft yarns Y, and located above the oblique warp yarns $\alpha'$. The weft yarns Y are located below the oblique warp yarns $\alpha'$ and are located above the oblique warp yarns $\alpha$. As a result, each of the points P where the oblique warp yarn $\alpha$ and $\alpha'$ and a weft yarn Y are interwoven is made rigid, which causes the fabric construction to become stable. The straight warp yarns $\beta$ at the selvage portion S are, at the upper side of the triaxial fabric Q, alternately located above and below the weft yarns Y. The straight warp yarns $\beta'$ at the selvage portion S are, at the lower side of the triaxial fabric Q, alternately located above and below the weft yarns Y in the opposite manner as that of the straight warp yarns $\beta$.

FIG. 12 shows an arrangement of the opposite arrays of the lower heddles L1 and L2 for obtaining the fabric as shown in FIG. 11*a*. Namely, a pair of spaced apart groove plates 2 are provided. Each plate 2 defines sets of three guiding grooves 2*a* which are spaced along the weft-wise direction z. The grooves 2*a* between the opposite plates 2 are alternately arranged so that, upon a shedding movement, any heddle 32 in one of the groups can be entered into a space between adjacent heddles in opposite group. Each of the heddles 32 in the arrays L1 and L2 may be arranged just below of the heddles 3 in the arrays U1 and U2, respectively, so that they are aligned or so that they are offset with each other as explained in the first embodiment with reference to FIG. 3. Similar to FIG. 1, each of the heddles 32 is formed with an eyelet 32*a* for threading the straight warp yarns (selvage yarns) $\beta$ and $\beta'$ from the drums 21. The sets of the heddles which are spaced along the direction of the axis which is transverse to the plane of the fabric as produced are moved by means of the drive mechanism 4 between a position where the straight warp yarns $\beta$ and $\beta'$ are located outside of the oblique warp yarns $\alpha'$ and $\alpha$, and a position where the straight warp yarns $\beta$ and $\beta'$ are located outside of the oblique warp yarns $\alpha$ and $\alpha'$ for creating sheds.

In order to produce the fabric as shown in FIG. 11, at time 1 the oblique warp yarns $\alpha$ and $\alpha'$ are moved forward to create a shed, to which a weft yarn Y is inserted. Then, a beating operation is done by the beater 14, and the oblique warp yarns $\alpha$ and $\alpha'$ are moved rearward. At time 2, no shedding operation nor weft inserting operation is done. At time 3, the oblique warp yarns $\alpha'$ and $\alpha$, as well as the straight warp yarns $\beta$ and $\beta'$ at the selvage portions, are moved forward, so that the straight warp yarns $\beta$ are located inwardly of the oblique warp yarns $\alpha$ which are now extended, and the straight warp yarns $\beta'$ are located inwardly of the oblique warp yarns $\alpha'$ which are also extended to create a shed. Then, a weft inserting operation is done to insert a weft yarn Y into the shed, and then a beating operation is done by the beater 14 so that the weft yarn Y falls toward the cloth. Then, the straight warp yarns $\beta$ and $\beta'$ are extracted. Similar to the previous examples, at each of times 1, 2, 3 and 4, an alternate, weft-wise movement of the oblique warp yarns $\alpha$ and $\alpha'$ is done. The repetition of these cycles can obtain a fabric, which has a central portion Q made as a triaxial fabric with a pair of selvage portions S, each of which is constructed as a quartaxial fabric constructed by a triaxial fabric including the oblique warp yarns $\alpha$ and $\alpha'$ and the weft yarns Y and the straight warp yarns $\beta$ and $\beta'$ which are interwoven with the weft yarns in the triaxial fabric at its upper and lower sides.

In this construction of the selvage portions S, during the taking up operation of the produced fabric by means of the beam 72 in FIG. 1 as shown by an arrow A in FIG. 11*a* in the length of the fabric, the force generated in the produced fabric will, even if it is large, not cause the fabric to be shrunk, due to the fact that the warp yarns $\beta$ and $\beta'$ are provided for opposing to the force in such a manner that the angle between the oblique warp yarns $\alpha$ and $\alpha'$ is maintained, thereby allowing the width of the fabric to be maintained unchanged. Thus, a superimposition of two of these multi-axial fabrics with opposite selvage portions to be sewed with each other allows a large width of a fabric to be obtained, while its width is stable, thereby field of the utilization thereof can be enhanced.

In a further example of the multi-axial fabric shown in FIGS. 13(*a*) and 13(*b*), at the intermediate portion Q of the fabric along the width thereof, another set of straight warp yarns $\gamma$ for reinforcing, which run along the direction transverse to the direction of the weft yarn, are provided at suitable spacing, so that straight warp yarns $\gamma$ are interwoven with the weft yarns Y. In this construction of a multi-axial fabric, upon being subjected to a stretching force in the weaving direction of the fabric, the existence of the straight warp yarns $\gamma$ can prevent the crossing angle between the oblique warp yarns from being changed, thereby preventing the fabric from beginning elongated in the weaving direction, causing the width of the fabric to be stable, and the stretching tension in the weaving or following process to be easily controlled. Furthermore, the thickness of the fabric can be reduced when compared with the construction in FIG. 5, where the straight warp yarns are interwoven along the entire width of the fabric.

In the above embodiments, the thickness of the straight warp yarns may be smaller than those of the oblique warp yarns and weft yarns. This is advantageous when a reduction of the thickness of the fabric is required.

According to the present invention, a quartaxial fabric is obtained, where, to a triaxial fabric where the oblique warp yarns of different directions and weft yarns are interwoven, straight warp yarns are interwoven. Thus, an increased engagement between the yarns is obtained to obtain a stable structure of the fabric as well as increased strength. Furthermore, the straight warp yarns are interwoven with the weft yarns along at least one side in its thickness, which allows the straight warp yarn to be easily interwoven. Furthermore, an increased density of the fabric is obtained.

Furthermore, the shedding device for the straight warp yarns are arranged on the side of the arrays of the heddle for the triaxial fabric, adjacent the cloth fell.

Thus, a mere modification of a conventional triaxial fabric is sufficient to obtain a quartaxial fabric, which allows its cost to be reduced. Finally, a shedding movement of the straight warp yarns is done also by heddles, thereby obtaining a fabric of an increased density.

What is claimed is:

1. A shedding device for a weaving machine which produces multi-axial fabric having oblique warp yarns of different directions, weft yarns and straight warp yarns, said shedding device comprising:

(a) first shedding means comprising (i) first heddles arranged as opposite arrays for guiding the oblique warp yarns, (ii) means for obtaining reciprocating movement of the first heddles in the respective arrays to create a shed for receiving a weft yarn, and (iii) means for obtaining alternate, opposite weft-wise movement of the opposite arrays of the first heddles upon completion of the shedding operation by the first shedding means for allowing the oblique warp yarns and the weft yarn to be interwoven with each other to create a triaxial fabric; and (b) second shedding means comprising (i) second heddles for guiding straight warp yarns at locations on one side of the first heddles adjacent to a cloth fell, and (ii) means for (1) preventing said second heddles from being moved along the weft-wise direction and (2) obtaining reciprocating movement of the second heddles so that the straight warp yarns are interwoven with respect to the weft yarn, while said second heddles are being prevented from being moved along the weft-wise direction.

2. A weaving machine for a multi-axial fabric having oblique warp yarns, weft yarns and straight warp yarns, comprising:

a plurality of sources for oblique warp yarns;

rotary supporting means for supporting said oblique warp yarn sources;

first shedding means for creating a shed between the oblique warp yarns;

means for inserting a weft yarn into the shed;

beating means for urging the inserted weft yarn toward a cloth fell;

means for taking up the fabric as produced;

said first shedding means comprising:

(i) pair of oppositely spaced apart arrays of first heddles for guiding the oblique warp yarns, (ii) a first guide plate defining a first plurality of guiding grooves for guiding the opposite arrays of the first heddles so that the heddles in the respective arrays are reciprocated in the first guiding grooves, (iii) a pair of spaced apart reciprocating plates which engage the first heddles in the respective array, (iv) means for obtaining reciprocating movement of the respective reciprocating plates of said first shedding means to obtain the reciprocating movement of the first heddles in the respective arrays, (v) means for obtaining alternate, opposite, weft-wise movement of the respective arrays of first heddles, and (vi) means for transferring a heddle at a leading end in the movement in one of the arrays to a tail end in the opposite movement in the other array;

a plurality of sources for straight warp yarns; and a second shedding device comprising:

(i) at least one set of second heddles for guiding the respective straight warp yarns, (ii) a second guide plate defining a second plurality of guiding grooves,for guiding the second heddles at positions on one side of the first heddles adjacent said cloth fell so that the second heddles in the respective arrays are reciprocated in the second guiding along a first axis, (iii) a reciprocating plate which engages the second heddles; and means for (i) preventing said second heddles from being moved along the weft-wise direction, and (ii) obtaining reciprocating movement applied to the respective reciprocating plates for obtaining the reciprocating movement of the second heddles, while the second heddles are being prevented from being moved along the weft-wise direction.

3. A weaving machine for multi-axial fabric having oblique warp yarns, weft yarns and straight warp yarns, comprising:

a plurality of sources for oblique warp yarns;

rotary supporting means for supporting said oblique warp yarn sources;

first shedding means for creating a shed between the oblique warp yarns;

means for inserting a weft into the shed;

beating means for urging the inserted weft toward a cloth fell to produce a fabric;

means for taking up the fabric as produced;

said first shedding means comprising:

(i) a pair of opposite arrays of first heddles for guiding the oblique warp yarns, (ii) a first guide plate defining a first plurality of guiding grooves for guiding the opposite arrays of the first heddles so that the first heddles in the respective arrays are reciprocated in the first guiding grooves, (iii) a first pair of reciprocating plates which engage the first heddles in the respective array, (iv) means for obtaining a reciprocating movement applied to the first respective reciprocating plates for obtaining the reciprocating movement of the first heddles in the respective arrays, (v) means for obtaining alternate, opposite weft-wise movement of the respective arrays of the first heddles, and (vi) means for transferring a heddle of said first heddles at a leading end in one of said arrays to a tail end in the opposite movement in the other array;

a plurality of sources for straight warp yarns, second shedding device comprising:

(i) a pair of spaced arrays of second heddles for guiding the straight warp yarns, said arrays of said second heddles being arranged on the sides of the respective arrays of the first heddles adjacent to the cloth fell, (ii) a second guide plate defining a second plurality of guiding grooves for guiding the opposite arrays of the second heddles so that the second heddles in the respective arrays are reciprocated in the second guiding grooves, (iii) a second pair of reciprocating plates which engage the second heddles in the respective array, (iv) means for obtaining a reciprocating movement applied to the second respective reciprocating plates for obtaining the reciprocating movement of the second heddles in the respective arrays, (v) means for obtaining alternate, opposite, weft-wise movement of the respective arrays of the second heddles, (vi) means for transferring a one of the second heddles provided at a leading end in the movement in one of said arrays to a tail end in the opposite movement in the other array, and clutch means arranged between a driving source and the transferring means, said clutch means adapted to be selectively disengagable so that the transferring movement of the second heddles in the weft-wise direction is prevented and only said reciprocating movement is allowed.

4. A weaving machine according to claim 8, further comprising turnbuckles between the reciprocating plates and the reciprocating means of the second shedding device for controlling the position of the second heddles with respect to the first heddles.

5. A method for weaving a multi-axial fabric, comprising the steps of:

providing a plurality of oblique warp yarns;

providing a pair of spaced arrays of first heddles for guiding the oblique warp yarns;

creating a reciprocating movement applied to respective reciprocating plates so as to obtain reciprocating movement of the first heddles in the respective arrays to create a shed;

obtaining opposite movement of the respective arrays of the first heddles;

transferring a one of the first heddles provided at a leading end in the movement in one of said arrays to a tail end in the opposite movement in other array;

providing a plurality of straight warp yarns;

providing at least one set of second heddles for guiding the respective straight warp yarns at location adjacent to a cloth fell;

creating a reciprocating movement, applied to respective reciprocating plates of the second heddles, so as to obtain reciprocating movement of the second heddles so that the straight warp yarns are shedded from an outer side of the oblique warp yarns, while the second heddles of said second shedding means are prevented from being moved along the weft-wise direction;

inserting a weft to the shed, and beating the weft yarn toward the cloth fell;

thereby producing a multi-axial fabric, wherein at substantially all locations where the oblique warp yarns are crossed with each other, the oblique warp yarns are interwoven with the weft yarns, and the straight warp yarns are interwoven with the weft yarn which are interwoven with the oblique warp yarns at said locations.

* * * * *